US010076203B1

(12) United States Patent
Parrella

(10) Patent No.: US 10,076,203 B1
(45) Date of Patent: Sep. 18, 2018

(54) SYSTEM AND METHOD FOR COMPRESSION GARMENT REMOVAL

(71) Applicant: Gary Parrella, Keewatin, MN (US)

(72) Inventor: Gary Parrella, Keewatin, MN (US)

( * ) Notice: Subject to any disclaimer, the term of this patent is extended or adjusted under 35 U.S.C. 154(b) by 0 days.

(21) Appl. No.: 15/974,615

(22) Filed: May 8, 2018

Related U.S. Application Data

(60) Provisional application No. 62/503,364, filed on May 9, 2017.

(51) Int. Cl.
*A47G 25/90* (2006.01)

(52) U.S. Cl.
CPC ..... *A47G 25/908* (2013.01); *A47G 25/90* (2013.01); *A47G 25/905* (2013.01)

(58) Field of Classification Search
CPC ..... A47G 25/908; A47G 25/80; A47G 25/90; A47G 25/905; A47G 25/907
See application file for complete search history.

(56) References Cited

U.S. PATENT DOCUMENTS 881,163 A * 3/1908 Spiess
3,070,271 A * 12/1962 Kennedy, Sr. ..... A47G 25/905 223/111
3,227,335 A * 1/1966 Minnema ..... A47G 25/905 223/111
3,396,882 A * 8/1968 Berlin ..... A47G 25/908 223/111
3,853,252 A * 12/1974 Scianimanico ..... A47G 25/905 223/111
4,072,255 A * 2/1978 Bogorad ..... A47G 25/905 223/111
4,130,226 A * 12/1978 Farrell ..... A47G 25/905 223/111
6,763,982 B1 * 7/2004 Livornese ..... A47G 25/82 223/111
D679,888 S * 4/2013 Sanchez-Garcia ..... D2/641
2005/0115994 A1 * 6/2005 Delamare ..... A47G 25/905 223/112

* cited by examiner

*Primary Examiner* — Ismael Izaguirre
(74) *Attorney, Agent, or Firm* — Uradnik Law Firm PC

(57) ABSTRACT

A system for compression garment removal includes a frame with a first ring-shaped portion having a forward portion, a rearward portion, and an opening therein to permit an individual's foot and lower leg to be placed through the opening, the rearward portion including a hook for engaging a compression garment; a handle coupled to the rearward portion of the first ring-shaped portion; and an elongated pushing rod adapted at one end to engage the forward portion of the first ring-shaped portion.

6 Claims, 9 Drawing Sheets

SYSTEM AND METHOD FOR COMPRESSION GARMENT REMOVAL

RELATED APPLICATIONS

This application is related to and claims priority from U.S. provisional patent application Ser. No. 62/503,364 filed May 9, 2017, entitled System and Method for Compression Garment Removal, which is hereby incorporated by reference herein for all purposes.

FIELD OF THE DISCLOSURE

The invention relates generally to a system and method for the removal of compression garments, and more particularly, to the removal of compression stockings from an individual's foot and lower leg.

BACKGROUND

A number of medical and athletic compression garments are in use today. Examples include, without limitation, compression socks, compression stockings, support hose, compression legwear, compression arm sleeves; compression armwear, etc. For convenience only, reference is made herein to compression stockings; however, the invention is not so limited.

Compression stockings are specially designed and made to exert pressure to the lower legs. Such stockings help maintain blood flow, reduce discomfort, reduce swelling, etc. A medical professional (physician) may prescribe the use of compression stockings for individuals with poor blood flow in their legs (e.g., persons with varicose veins). Compression stockings may be referred to as TED hose, short for thromboembolism-deterrent hose. They are used to support the venous and lymphatic drainage of the leg. Many diabetics benefit from less swelling when wearing compression stockings.

It is often difficult for an individual to remove a compression stocking. Grabbing a compression stocking and pulling on it runs a risk of tearing. Also, many individuals who use compression stockings suffer from conditions (such as arthritis) that make compression stocking removal difficult.

Thus, there remains a need for an improved system and method for the removal of compression garments.

SUMMARY

The present disclosure provides a system and method for the removal of compression garments, and more specifically, without limitation, compression stockings. A frame is adapted to fit over an individual's foot and lower leg and to engage the upper end of the compression stocking. By directing the frame downward, off the leg and over the foot, the compression stockings may be removed with relative ease.

Other benefits and advantages of the present disclosure will be appreciated from the following detailed description.

DESCRIPTION OF THE DRAWINGS

Exemplary embodiments of an exemplary system and method for the removal of compression garments are shown in the accompanying drawings.

DETAILED DESCRIPTION

Embodiments of the invention and various alternatives are described. Those skilled in the art will recognize, given the teachings herein, that numerous alternatives and equivalents exist which do not depart from the invention. It is therefore intended that the invention not be limited by the description set forth herein or below.

One or more specific embodiments of the system and method will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Further, for clarity and convenience only, and without limitation, the disclosure (including the drawings) sets forth exemplary representations of only certain aspects of events and/or circumstances related to this disclosure. Those skilled in the art will recognize, given the teachings herein, additional such aspects, events and/or circumstances related to this disclosure, e.g., additional elements of the devices described; events occurring related to compression garment removal; etc. Such aspects related to this disclosure do not depart from the invention, and it is therefore intended that the invention not be limited by the certain aspects set forth of the events and circumstances related to this disclosure.

Figure 1:
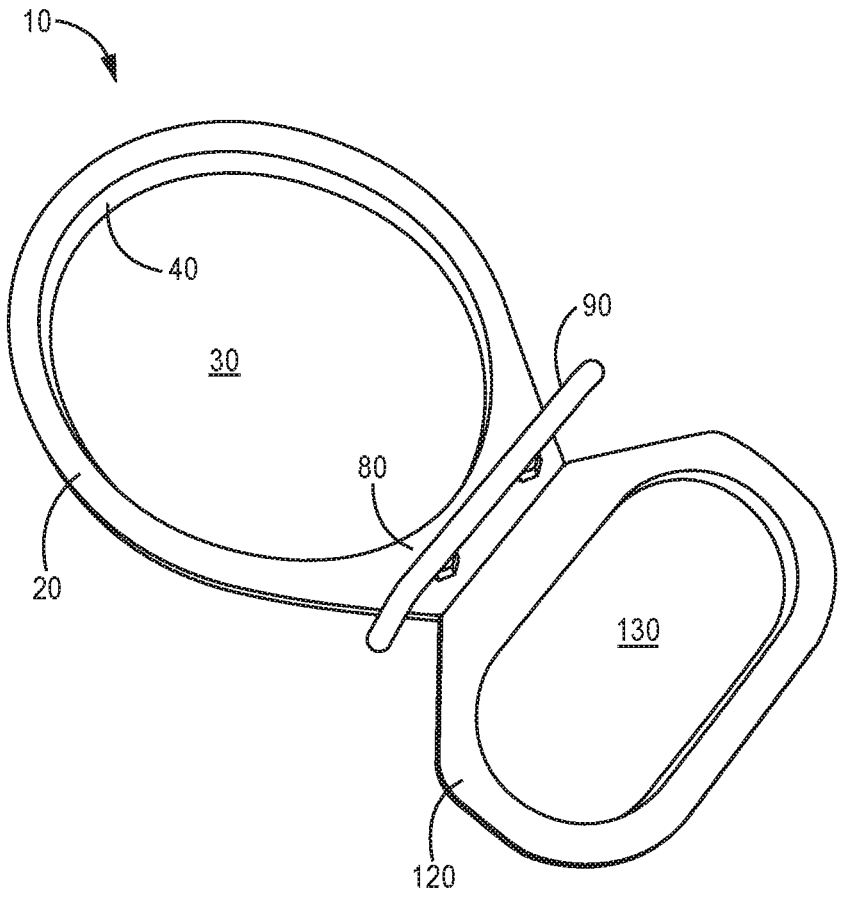
FIG. 1 is a perspective view from below of an exemplary frame assembly of an exemplary system for compression garment removal.
Figure 2:
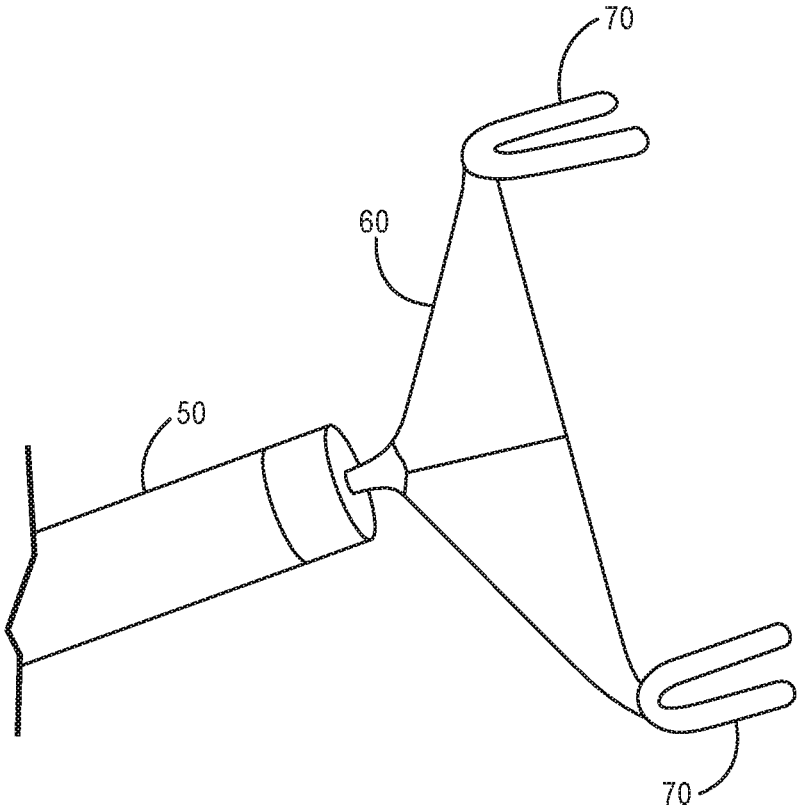
FIG. 2 is a perspective view from a first side of an exemplary end of a pushing rod adapted for use with the exemplary frame assembly shown in FIG. 1.
Figure 3:
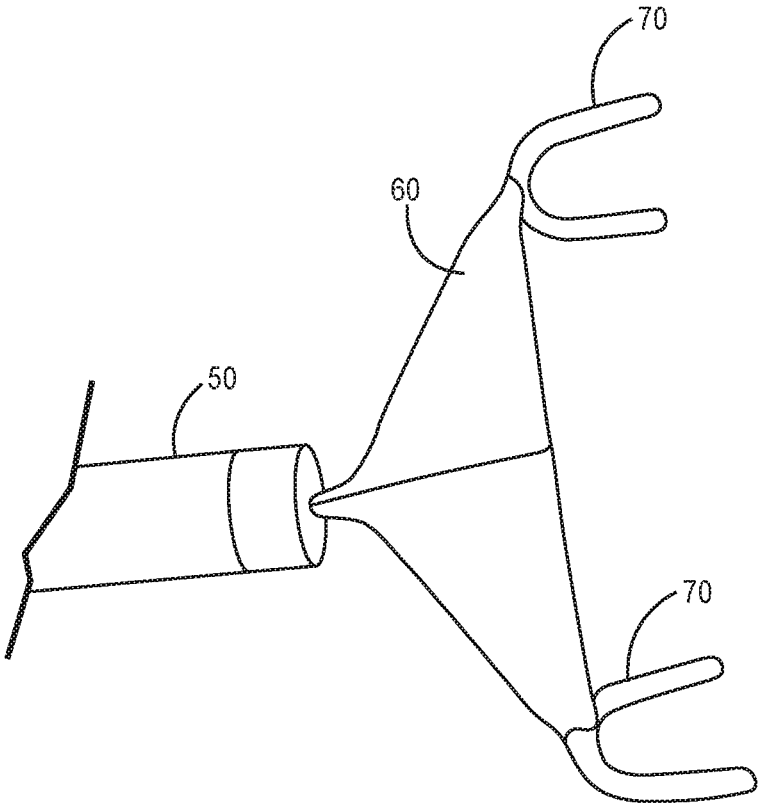
FIG. 3 is a perspective view from a second side of the exemplary end of a pushing rod shown in FIG. 2.

Turning now to the drawings, an exemplary system and method for the removal of compression stockings is provided. As shown in FIG. 1, a frame 10 includes a first portion 20 comprising a ring of sufficient size and shape to permit an individual's foot and lower leg to be placed through a central opening 30 therein. As shown in the drawings, the portion 20 includes a generally oval-shaped ring. However, portions 20 of other shapes and sizes may be used.

The portion 20 includes a forward end 40 adapted in size and shape so that it may be pushed along and off of an individual's leg that is inserted through the opening 30. The end 40 may be pushed by hand. Alternately, the end 40 may be engaged by a pushing rod 50. The rod 50 may include an end 60 having one or more generally u-shaped extensions 70 adapted to removably engage with the forward end 40 of frame 10. See, e.g., FIG. 4, in which the extensions 70 generally engage the top of the forward end 40 of frame 10. The rod 50 may be of sufficient length so that pushing the forward end 40 of frame 10 along and off of an individual's foot may be accomplished without the individual having to uncomfortably bend at the waist. The rod 50 in one exemplary embodiment may be sized approximately as long as a walking stick or cane.

Figure 4:
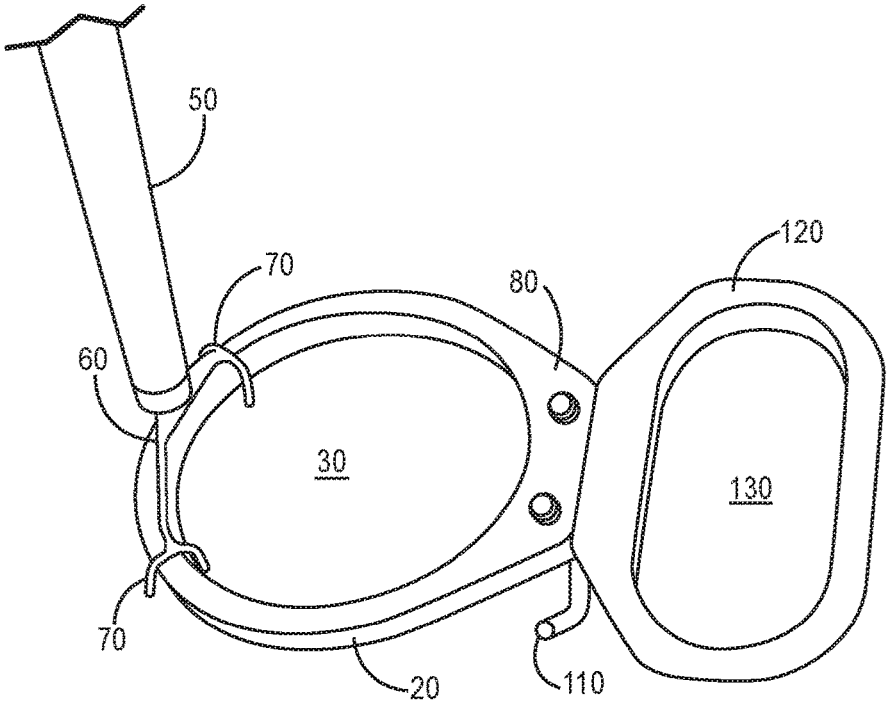
FIG. 4 is a perspective view from above of the exemplary frame assembly shown in FIG. 1 engaging in an exemplary manner with the end of the pushing rod shown in FIGS. 2 and 3.
Figure 5:
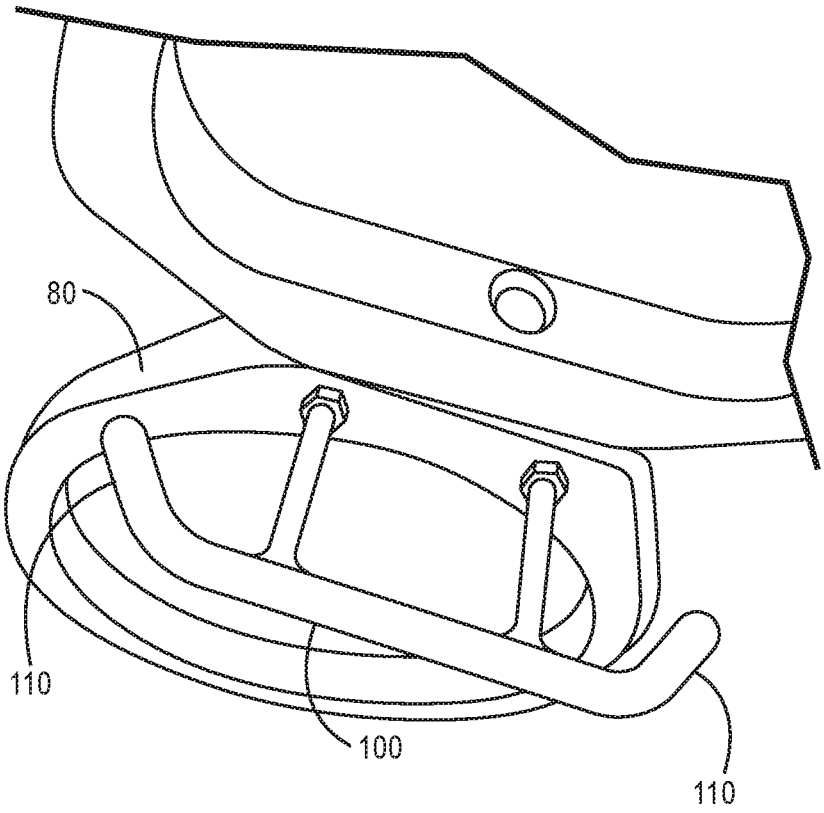
FIG. 5 is a perspective view from below of a portion of the exemplary frame assembly shown in FIG. 1.

The first portion 20 of frame 10 may include a rearward portion 80. As shown in FIG. 1 and FIG. 4, for example, the rearward portion 80 at its bottom side may be adapted with a hook 90 for engaging a compression stocking. The hook 90 includes a support 100 and one or more upwardly extending catches 110. As shown in the drawings (see FIG. 5), the support 100 includes two struts and a cross piece that are attached to the rearward portion 80 by a bolt, threaded portion and nut, or similar fastening arrangement. The catches 110 generally extend upwardly and outwardly from the ends of the cross piece of support 100.

Figure 6:
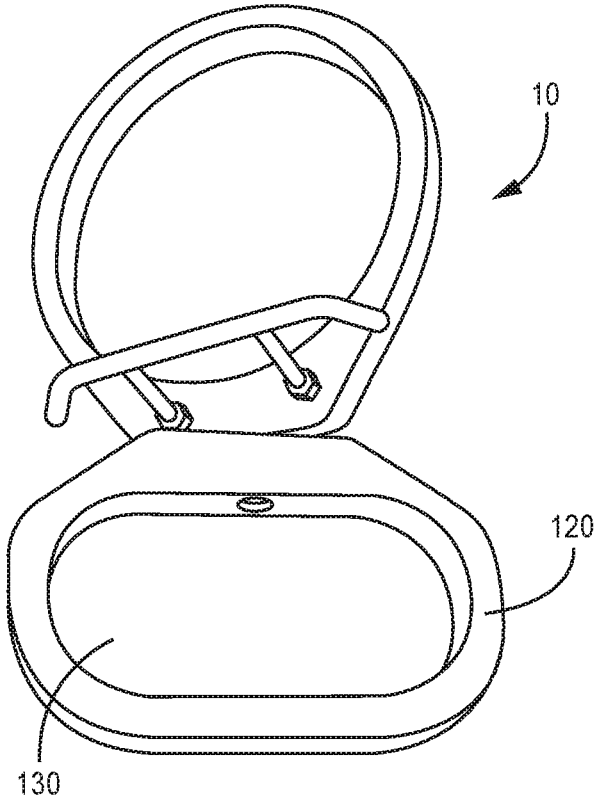
FIG. 6 is a perspective view from below of the exemplary frame assembly shown in FIG. 1, with the handle rotated in a first (e.g., clockwise) direction relative to the first portion of the frame assembly.
Figure 7:
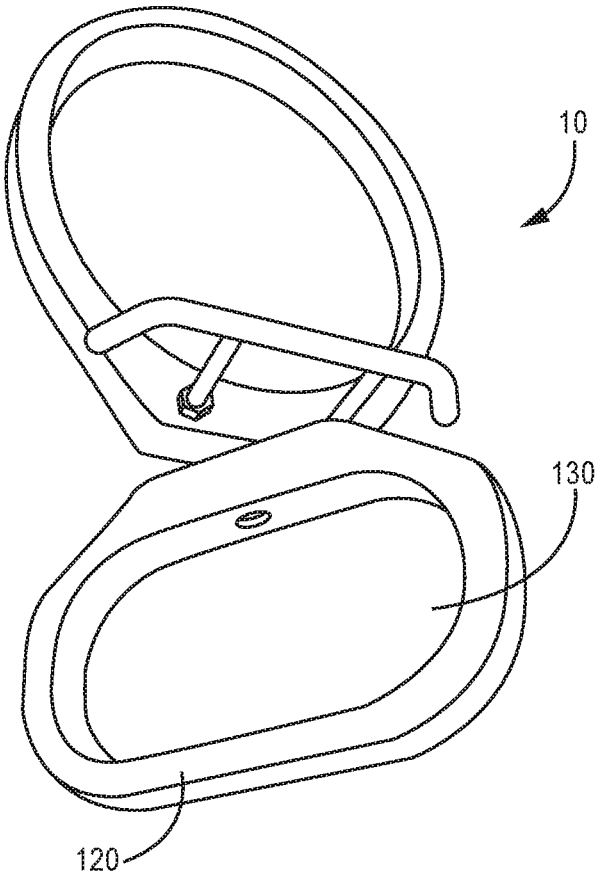
FIG. 7 is a perspective view from below of the exemplary frame assembly shown in FIG. 1, with the handle rotated in a second (e.g., counterclockwise) direction relative to the first portion of the frame assembly.

As shown in FIGS. 1, 6, and 7, the frame 10 includes a handle 120 that is hingedly attached to the rearward portion 80 of first portion 20 of frame 10. The handle 120 provides a location upon which the frame 10 may be pushed to help direct the frame 10 along and off of an individual's leg and foot inserted through opening 30. The handle 120 need not be hingedly attached. The handle 120 may be fixedly attached to rearward portion 80 and may integrally formed therewith. However, by having a hinged connection, it allows the handle 120 to be oriented in the most comfortable position for the task of pushing on the frame 10. The handle 120 may be rotatable about a central axis of the first portion 20 of the frame 10. Compare FIGS. 6 and 7, showing that the handle 120 may be rotated in either direction about the central axis to accommodate removal of a compression stocking from either the right or left leg.

Figure 8:
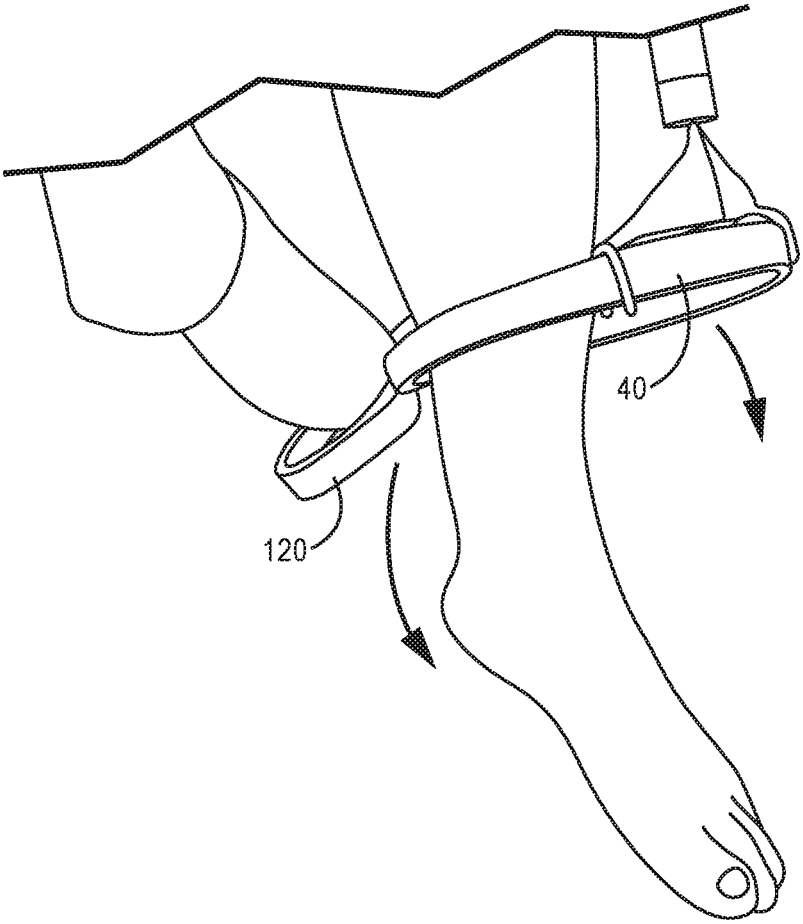
FIG. 8 is a first perspective view of the exemplary frame assembly shown in FIG. 1 and pushing rod portion as shown in FIGS. 2 and 3, positioned over an individual's lower leg portion and foot from which a compression garment is to be removed, with the other foot engaging the handle of the frame assembly in an exemplary manner.
Figure 9:
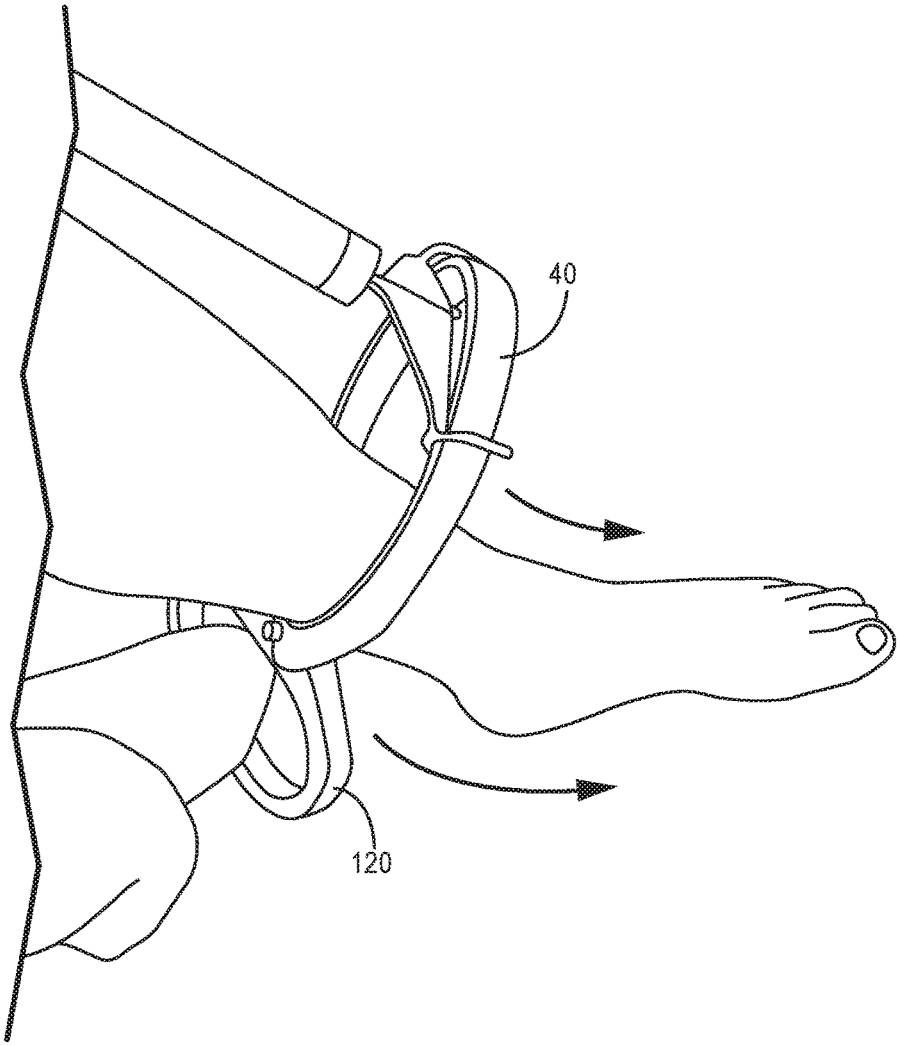
FIG. 9 is a second perspective view of the exemplary frame assembly shown in FIG. 1 and pushing rod portion as shown in FIGS. 2 and 3, positioned over an individual's lower leg portion and foot from which a compression garment is to be removed, with the other foot engaging the handle of the frame assembly in an exemplary manner.

The pushing at handle 120 may be by hand. Alternately, the foot of the other leg (i.e., the leg not inserted through opening 30) may be inserted in part into opening 130 of handle 120 and be used to push the frame 10 along and off of an individual's leg inserted in opening 30. See FIG. 8 and FIG. 9.

In accordance with the present disclosure, removing a compression stocking from an individual's lower leg includes the steps of: placing the frame 10 about the leg by inserting the foot and leg through the opening 30. At the upper end of the stocking, a portion of the stocking is hooked to catches 110. The rearward handle 120 is engaged by the foot of the other leg that is not inserted through opening 30. At the same time, pushing rod 50 engages the forward end 40 of frame 10. By pushing downward on the handle 120 and forward end 40 simultaneously, the frame 10 travels along the leg and over the foot, thus removing the stocking as it goes.

It should be understood that the foregoing description is only illustrative of the invention. Various alternatives and modifications can be devised by those skilled in the art having the benefit of this disclosure, without departing from the invention. Accordingly, the invention is intended to embrace all such alternatives, modifications and variances.

Certain exemplary embodiments of the disclosure may be described. Of course, the embodiments may be modified in form and content, and are not exhaustive, i.e., additional aspects of the disclosure, as well as additional embodiments, will be understood and may be set forth in view of the description herein. Further, while the invention may be susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the spirit and scope of the invention.

What is claimed is:

1. A system for compression garment removal comprising:

(a) a frame including:

(i) a first ring-shaped portion having a forward portion, a rearward portion, and an opening therein to permit an individual's foot and lower leg to be placed through the opening, the rearward portion including a hook for engaging a compression garment; and (ii) a handle hingedly attached to the rearward portion of the first ring-shaped portion; and (b) an elongated pushing rod adapted at one end to engage the forward portion of the first ring-shaped portion.

2. The system of claim 1, wherein the handle includes an opening therein sized to permit insertion of a portion of an individual's foot therethrough.

3. The system of claim 2, wherein the handle is ring-shaped.

4. The system of claim 1, wherein the handle is rotatable about a central axis of the first ring-shaped portion.

5. The system of claim 1, wherein the hook includes one or more catches for engaging a compression garment.

6. The system of claim 1, wherein the pushing rod includes one or more generally u-shaped extensions adapted to removably engage with the forward portion of the first ring-shaped portion.

* * * * *